US007252607B2

(12) United States Patent
Gormley

(10) Patent No.: US 7,252,607 B2
(45) Date of Patent: Aug. 7, 2007

(54) ANCHOR FITTING FOR A HOLLOW BALL

(75) Inventor: Ian Gavin Gormley, Morningside (ZA)

(73) Assignee: European Sports Merchandising BV, Amsterdam (NL)

( * ) Notice: Subject to any disclaimer, the term of this patent is extended or adjusted under 35 U.S.C. 154(b) by 0 days.

(21) Appl. No.: 11/219,937

(22) Filed: Sep. 6, 2005

(65) Prior Publication Data

US 2006/0052188 A1 Mar. 9, 2006

(30) Foreign Application Priority Data

Sep. 7, 2004 (ZA) ..... 2004/7153

(51) Int. Cl.
*A63B 43/00* (2006.01)

(52) U.S. Cl. ..... 473/575; 473/576; 473/423

(58) Field of Classification Search ..... 473/575, 473/576, 596, 597, 610, 611, 423–430
See application file for complete search history.

(56) References Cited

U.S. PATENT DOCUMENTS 1,488,070 A * 3/1924 Selfert ..... 411/165
1,513,773 A * 11/1924 Thompson ..... 473/576
1,578,889 A * 3/1926 Harris ..... 411/246
3,729,195 A * 4/1973 Hutt et al. ..... 473/575
3,764,140 A * 10/1973 Lotfy ..... 473/575
3,829,093 A * 8/1974 Abrams ..... 473/575
4,162,790 A * 7/1979 Kelsey ..... 473/575
4,192,044 A * 3/1980 Ballerini ..... 473/575
4,248,423 A * 2/1981 Lotfy ..... 473/571
5,181,726 A * 1/1993 Piaget ..... 473/576

* cited by examiner

*Primary Examiner*—Steven Wong
(74) *Attorney, Agent, or Firm*—Dean W. Russell; Kilpatrick Stockton LLP

(57) ABSTRACT

An anchor fitting for a hollow ball includes a pair of shoulder defining bodies and an anchor body. These are located within the ball, the anchor body holding the shoulder defining bodies in place with respect to the ball so that with the anchor body having a cord, a tail, or a stem for a tail anchored thereto, the shoulder defining bodies will be effective for retaining the anchor fitting within the ball while playing a game which involves the ball being struck with a bat or racquet. The parts of the fitting are separately displaced through a hole in the wall of a ball, the anchor body permitting cooperation with an elongate element for facilitating the effective assembly of the fitting.

17 Claims, 5 Drawing Sheets

ANCHOR FITTING FOR A HOLLOW BALL

CROSS REFERENCE TO RELATED APPLICATION

This application claims priority to South African Patent Application No. 2004/7153 filed on Sep. 7, 2004, the contents of which are incorporated herein by reference.

THIS INVENTION relates to an anchor fitting for a hollow ball.

It is known in relation to certain ball and racquet-type games that the ball has one of a cord, a tail and a stem for a tail, anchored thereto. For example, for tether ball-type racquet games, the balls have cords anchored thereto, whereas for other tennis-type racquet games, balls have tails anchored thereto, either directly or via elongate, resiliently flexible stems.

Particularly for a hollow ball that must have a cord, a tail or a stem for a tail anchored thereto, an anchor is provided by a relatively large, substantially rigid anchor formation that is displaced through a hole provided therefor in the wall forming the ball, into the interior of the ball, the anchor formation then having the cord, the tail or the stem for a tail engaged therewith, for effective anchoring thereof with respect to the ball. It will be understood in the above regard that because the wall forming the ball generally is of a resiliently deformable rubber material, the anchor formation must be significantly larger than the hole provided therefor in the wall, for ensuring that the anchor formation remains secure within the ball and does not escape from the ball, during play of a game with the ball. Because of this requirement, displacement of an anchor formation through a hole in the wall forming a ball is very difficult and time consuming and also often causes damage to the wall, particularly splitting of the wall, which will result in the ball having a limited playing life.

It is thus an object of this invention to facilitate anchoring of a cord, a tail, or a stem for a tail, to a hollow ball, while also at least ameliorating the above problems known to be associated therewith.

Any reference hereinafter to a ball must be interpreted as a reference to a hollow ball having a wall of a resiliently deformable rubber, or like, material forming the ball, the wall having a hole formed therein for enabling anchoring of a cord, a tail or a stem for a tail, to the ball. The hole, where convenient, shall merely be referred to hereinafter as the hole in the ball.

According to the invention there is provided an anchor fitting for a ball which includes, in its operative configuration with respect to a ball, at least one shoulder defining body of a substantially rigid material which defines a hole therethrough and which, when operatively positioned with its hole in register with the hole in the ball, forms shoulder formations that extend substantially radially with respect to the hole in the ball and that abut the interior side of the wall forming the ball; and an anchor body of a substantially rigid material which defines an elongate shank portion and a head at one end of the shank portion, the shank portion operatively extending through the hole in the shoulder defining body and the hole in the ball and the head bearing against the shoulder defining body for holding the shoulder defining body in position, and in which the anchor body defines for the assembly of the ball an engagement formation which permits engagement by an elongate assembly element in a configuration in which, with an assembly element passing through the hole in the shoulder defining body and with the shoulder defining body and the anchor body separately displaced through the hole in the ball, the assembly element may be pulled externally of the ball for locating the shoulder defining body and the anchor body in their operative configurations with respect to the ball; and an anchoring formation which permits anchoring a required one of a cord, a tail and a stem for a tail, thereto.

By providing the anchor fitting in the form of separate body parts, i.e. an anchor body and at least one shoulder defining body, the relatively small bodies, that in their operative configuration form a relatively large body, can be displaced through the hole in a ball relatively easily, while providing for an effective anchor when forming the larger body after displacement through the hole.

One particular embodiment of the anchor fitting of the invention includes two shoulder defining bodies which each define a hole therethrough and which, when operatively positioned with their respective holes in register with the hole in the ball, form two pairs of shoulder formations that extend substantially perpendicularly with respect to one another and that abut the interior side of the wall forming the ball. The shoulder defining bodies may define complementary formations that serve to locate the bodies with respect to one another during assembly of the anchor fitting with the aid of an assembly element that passes through the holes in the shoulder defining bodies and that engages the anchor body.

The exact configuration of the shoulder defining bodies is greatly variable, it being envisaged in particular that each shoulder defining body, that abuts the interior side of the wall forming a ball in the operative configuration thereof, comprises an elongate substantially flat body that is provided with a curved surface profile segment that is complementary to and that abuts the interior side of the wall forming the body, in its operative configuration. The effective length of the substantially flat body forming a shoulder defining body may be variable and particularly is equal to at least two times the diameter of the hole in the ball with respect to which the anchor fitting is operatively associated.

Further according to the invention, the anchor fitting may include a retaining body operatively securely located on the shank portion of the anchor body, externally of the ball, for securing the location of the anchor fitting on the ball. The retaining body may be a washer-type formation that is resiliently deformable to permit its displacement over the shank portion of the anchor body into engagement with a peripheral groove defined therefor within the shank portion of the anchor body.

The engagement formation defined by the anchor body may be a passage arrangement defined by a first passage extending axially through the elongate shank portion and the head of the anchor body and a second passage extending radially through the head of the anchor body from an external location on the head to the first passage. Alternatively, the engagement formation defined by the anchor body may be a passage that extends diametrically through the shank portion of the anchor body near the end thereof remote from the head thereof. Still alternatively, the engagement formation defined by the anchor body may be a passage that extends axially through the elongate shank portion and the head of the anchor body. The engagement formations as defined particularly permit engagement by an elongate assembly element in the form of an elongate cord by being suitably threaded through the passages and, where necessary, permit retraction of the elongate cord from the anchor body after the assembly of the anchor fitting.

For the configuration of the anchor fitting in which the anchoring formation defined by the anchor body permits anchoring of a cord to the anchor body, the anchoring formation is defined by the axial passage through the elongate shank portion and the head of the anchor body that forms the engagement formation, the axial passage permitting the cord to extend therethrough into the ball with a knot at the end of the cord within the ball preventing retraction of the cord and permitting the cord also to serve the purpose of the elongate assembly element. Particularly where the anchor fitting permits anchoring of a cord to the anchor body as above defined, the anchor fitting may include an intermediate body operatively located between the knot of the cord and the head of the anchor body to operatively bear against the head of the anchor body in use of the ball and to permit free rotation of the cord within the axial passage defined through the elongate shank portion and the head of the anchor body.

Particularly for an anchor fitting that provides for anchoring of a stem for a tail for a ball to the anchor body, the anchoring formation may be defined by the shank portion of the anchor body by a receiving formation formed to receive and locate a complementary formation defined at the end of a stem. The receiving formation may be defined internally within the shank portion of the anchor body, the shank portion defining a slit formation therein that permits the passage of the complementary formation into the receiving formation through resilient deformability of the shank portion. Also for this arrangement, the retaining body may serve to enhance the secure location of the stem for a tail for a ball with respect to the anchor body.

The invention extends also to a ball which includes an anchor fitting, in accordance with the invention, as part thereof. Such a ball particularly may include also one of a cord, a tail and a stem for a tail anchored to the anchor body of the anchor fitting via the anchoring formation defined by the anchor body.

Further features of the invention are described hereafter with reference to examples of anchor fittings, in accordance with the invention, that are illustrated in the accompanying diagrammatic drawings. In the drawings.

Figure 1:
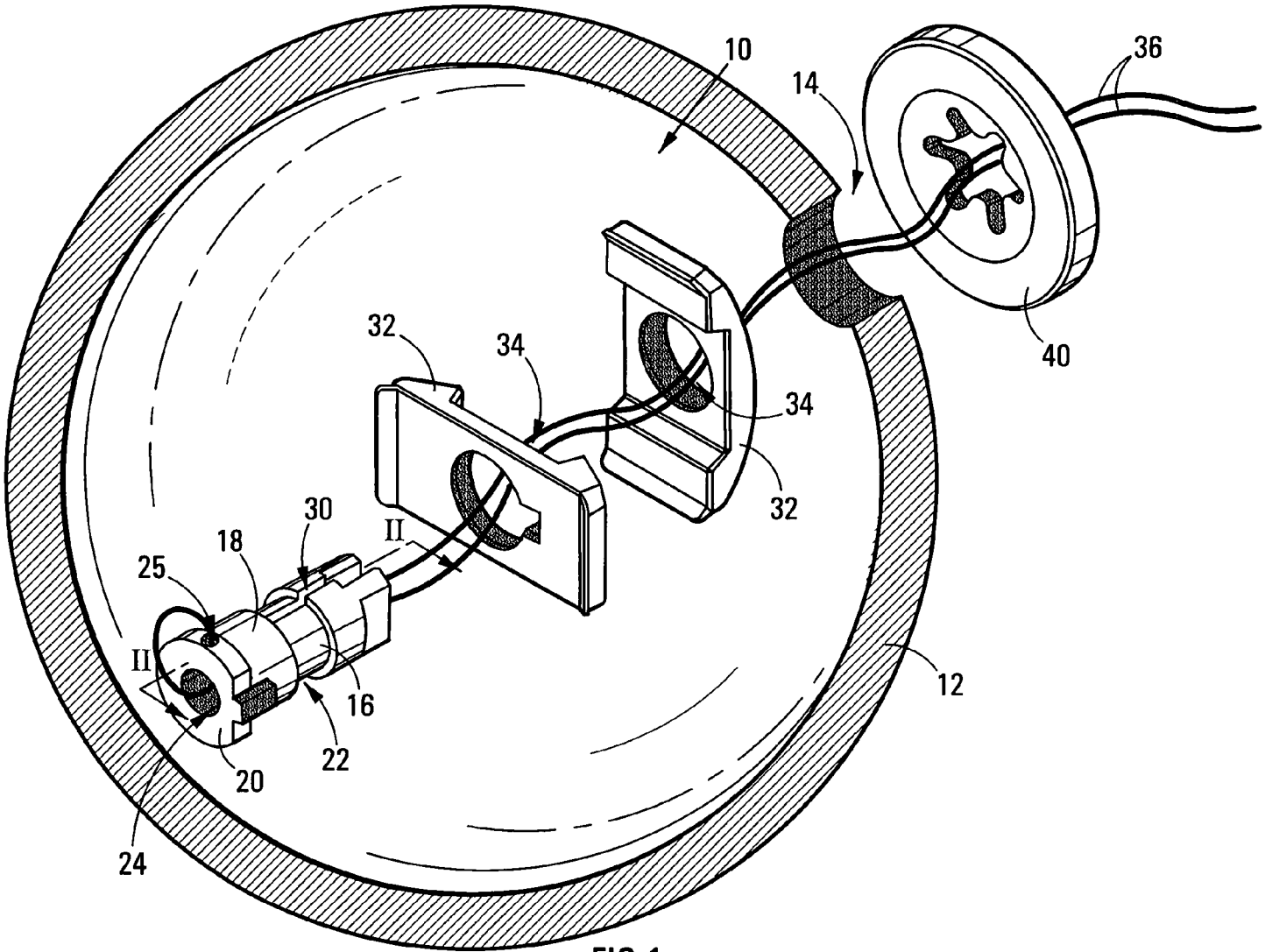
FIG. 1 shows a schematic three-dimensional view of a first embodiment of an anchor fitting for a ball, in accordance with the invention, in a pre-assembled configuration thereof.

Referring initially to FIGS. 1 to 5 of the drawings, an anchor fitting for a ball, in accordance with the invention, is designated generally by the reference numeral 10. The anchor fitting 10 is shown in a pre-assembled configuration thereof in FIG. 1 of the drawings and is shown in its assembled configuration in FIG. 4 of the drawings. The anchor fitting is particularly configured to enable anchoring of a stem for a tail for a ball, to the ball.

A ball with which the fitting 10 can be used is designated by the numeral 12 and specifically is a hollow rubber ball that has an aperture 14 defined in the wall forming the ball, the aperture facilitating the location of the anchor fitting 10, as is described hereafter.

The anchor fitting 10 includes an anchor body 16 which defines an elongate shank portion 18 and a head 20 at one end of the shank portion, the diameter of the head 20 being slightly larger than that of the shank portion 18. The shank portion further defines a peripheral groove 22 therein at a location between opposite ends thereof, the exact location of the groove 22 becoming apparent from the description that follows.

Figure 2:
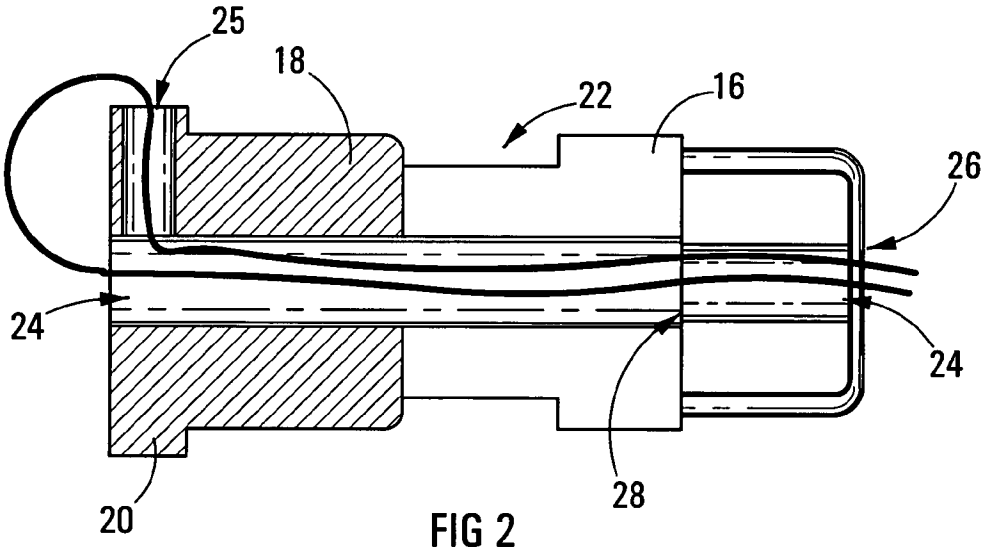
FIG. 2 shows a cross-sectional side view of the anchor body of the anchor fitting of FIG. 1, along line II-II of FIG. 1.

The anchor body 16 defines a first passage 24 axially therethrough, the diameter of the passage at the end segment adjacent the end 26 of the anchor body 16 being smaller than that of the remainder of the passage, as is illustrated clearly in FIG. 2 of the drawings. The passage 24 thus defines an internal shoulder formation 28 which will serve the purpose described in more detail hereafter. The anchor body also defines a second passage 25 in the head thereof that leads to the passage 24.

Figure 3:
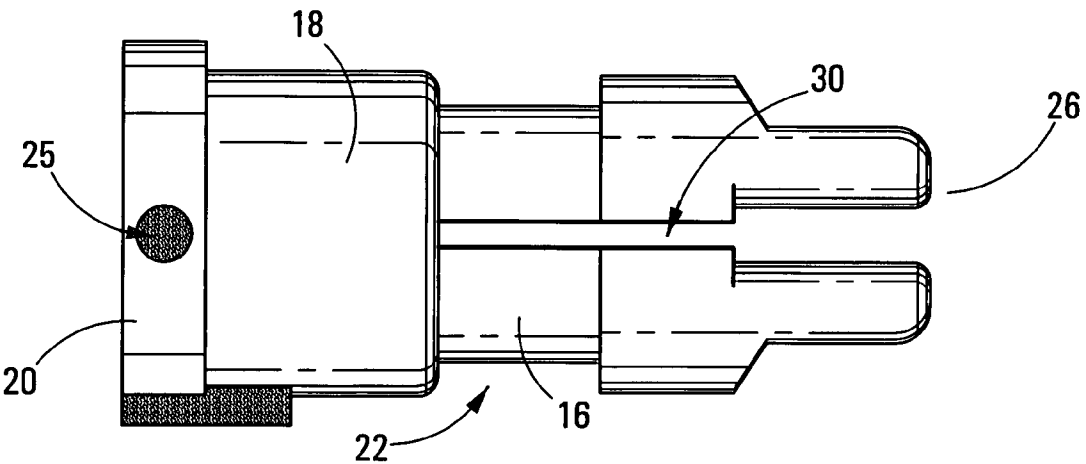
FIG. 3 shows a side view of the anchor body of FIG. 2 rotated through 90°.
Figure 4:
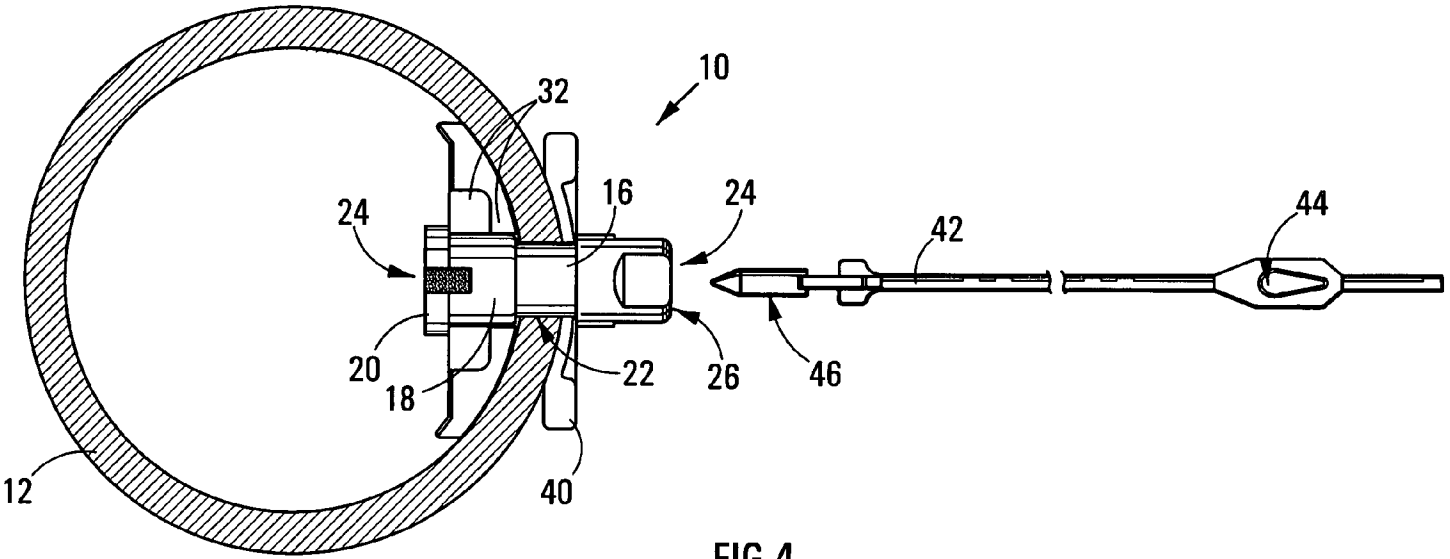
FIG. 4 shows a side view of the anchor fitting of FIG. 1, in its operative configuration with respect to a ball.

As is also clear from FIGS. 2 and 3 of the drawings, a diametrical slit formation 30 extends into the anchor body 16 from the end 26 thereof, the slit formation permitting limited resilient deformation of the two halves of the anchor body as defined on opposite sides of the slit formation 30, the purpose of which is again described in more detail hereafter.

The anchor fitting 10 includes further two shoulder defining bodies 32, each shoulder defining body defining a hole 34 therethrough which defines a diameter that will permit the entire shank portion 18 of the anchor body 16 to fit slidably therethrough.

Figure 5:
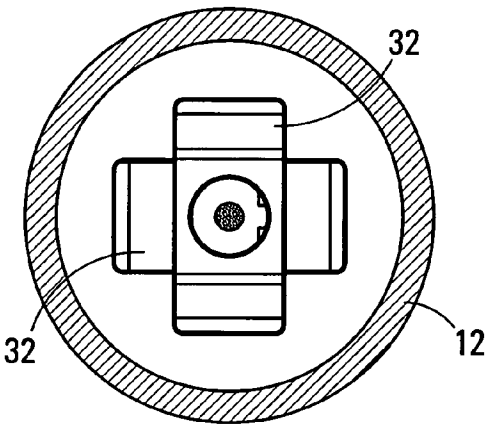
FIG. 5 shows an elevational rear view of the anchor fitting as shown in FIG. 4, within the interior of the ball.

The opposing faces of the shoulder defining bodies 32, as shown particularly in FIG. 1 of the drawings, define complementary formations that provide for the location of the shoulder defining bodies with respect to one another in a configuration in which they are disposed at right angles to one another (as shown in FIG. 5 of the drawings). The shoulder defining bodies 16 particularly comprise bodies provided with curved surface profile segments as shown, the curved surface profile segments providing for profiled faces that are complementary to the internal face profile of the wall forming the ball 12, where the shoulder defining bodies abut against the wall forming the ball, in the operative configuration of the anchor fitting, as described hereafter.

For the assembly of the anchor fitting with respect to the ball 12, an assembly cord 36 is threaded through the holes 34 in the shoulder defining bodies 32 and through the passage 24 in the anchor body 16 and then return threaded in an opposite direction entering the passage 24 via the passage 25, as is clearly illustrated in FIG. 2 of the drawings. The assembly cord 36 will thus have its two opposite ends extending from the ball, as shown, the assembly process of the anchor fitting being initiated, after threading of the assembly cord 36 through the parts thereof as described, by the sequential displacement of the anchor body 16 and the two shoulder defining bodies 32, through the hole 14 in the ball 12, into the ball. When displaced through the hole 14, as illustrated in FIG. 1 of the drawings, by pulling both ends of the assembly cord 36 away from the ball 12, the anchor body and the shoulder bodies will be pulled towards the interior face of the ball 12 into a position in which the shoulder bodies abut against this face of the ball, while disposed perpendicularly to one another as shown in FIG. 5, and the shank portion 18 of the anchor body 16 is displaced through the holes 34 in the shoulder defining bodies 32 and through the hole 14 in the ball, to have an end segment thereof extending externally from the ball 12. When so assembled, by pulling one end of the assembly cord 36 it can be retracted from the assembled anchor fitting, it being envisaged that either before or after such retraction, a retaining washer 40 formed of a resiliently deformable plastics material can be displaced over the shank portion 18 of the anchor body 16 into engagement with the anchor body 16 via the groove 22 defined thereby, thereby securing the location of the anchor fitting with respect to the ball.

The parts of the anchor fitting 10 are all formed of a substantially rigid material, typically a synthetic plastics material, thus ensuring that through the rigidity of the anchor fitting that is created, when disposed in its operative configuration, the fitting will be effectively anchored with respect to the ball and cannot be separated from the ball by being pulled therefrom. It will be understood in the above regard that particularly the portion of the anchor fitting disposed within the ball will be relatively large, while the individual parts of the anchor fitting are relatively small, the parts of the anchor fitting thus being displaceable through the hole 14 in the ball relatively easily, particularly without damaging the wall forming the ball. As such, fitting of the anchor fitting to a ball is considered relatively simple and quick, while secure location of the anchor fitting is simultaneously ensured. It is particularly envisaged that the effective length of the shoulder defining bodies will equal at least two times the diameter of the hole 14 defined in the ball.

The anchor fitting 10 as described is particularly adapted for anchoring an elongate stem for a tail for the ball 12 to the ball, a typical elongate stem formed of a resiliently deformable synthetic plastics material being designated by the reference numeral 42. The stem 42 has streamers (not shown) forming a tail secured at one end thereof, via a hole 44, whereas the opposite end of the stem defines an arrow head formation 46. For anchoring of the stem 42 to the anchor fitting 10 and thereby the ball 12, the arrow head formation is displaced through the small diameter end of the passage 24 defined axially through the anchor body 16, the inherent resilient deformability of the anchor body in this region, as provided for by the slit formation 30, permitting the relatively larger arrow head formation 46 to enter the larger diameter segment of the passage 24, which will result in the halves of the anchor body adjacent the slit formation 30 to again be displaced towards one another. Thereby, the location of the arrow head formation 46 within the space defined by the passage 24 is secured. It will be appreciated in this regard that the retaining washer 40 may serve also to retain the anchor body 16 in a configuration in which deformation to permit release of the arrow head formation is inhibited.

It must be appreciated in the above regard that the anchoring formation as provided by the anchor fitting may be designed in many different configurations in order to accommodate different complementary formations of a stem for a tail, or formations provided by any alternative component to be anchored to an associated ball.

Figure 6:
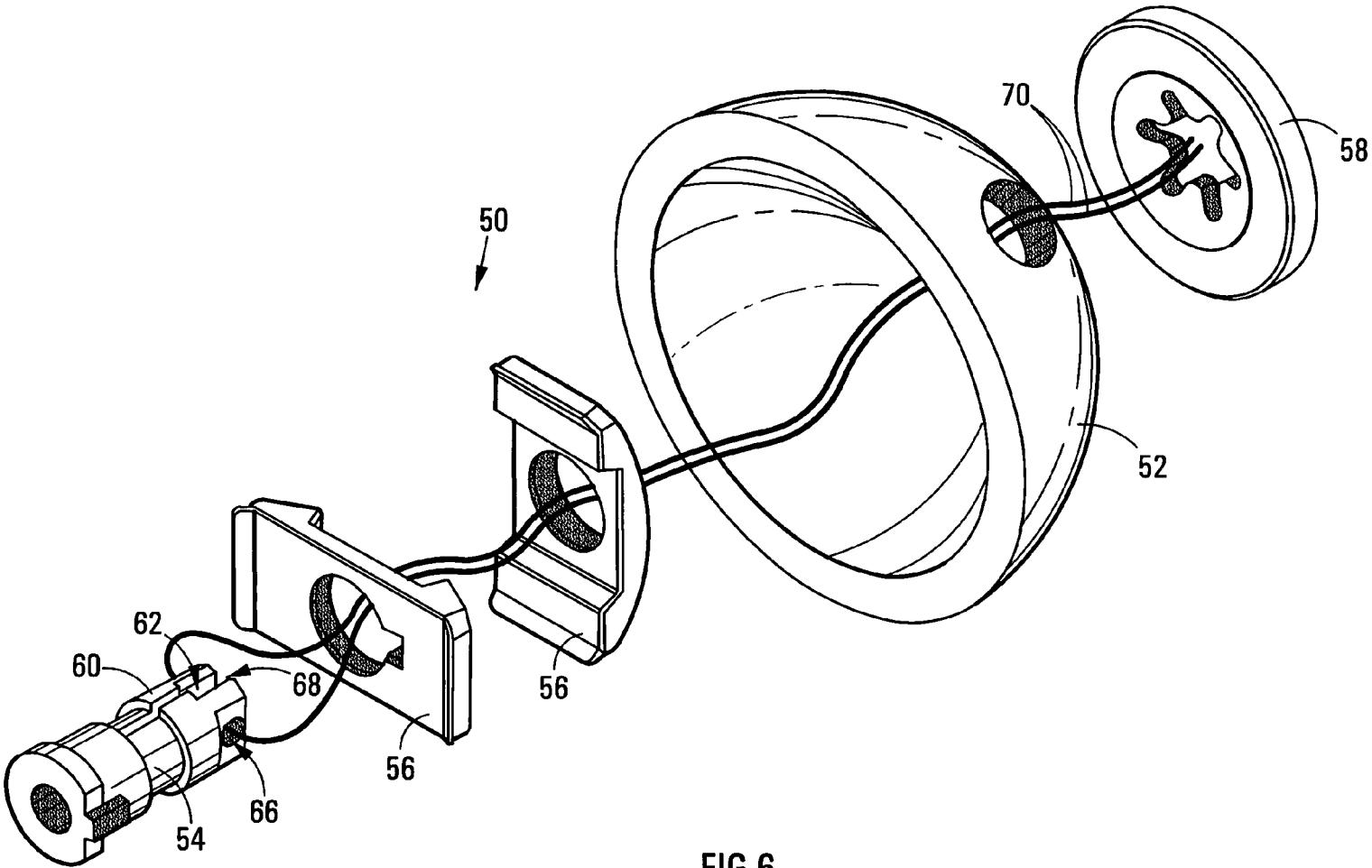
FIG. 6 shows a three-dimensional view of a second embodiment of an anchor fitting for a ball, in accordance with the invention.

Referring particularly to FIG. 6 of the drawings, a second embodiment of an anchor fitting, in accordance with the invention, is designated generally by the reference numeral 50. The anchor fitting 50 is provided for use with a ball 52 (only half the ball being shown) and again includes an anchor body 54, two shoulder defining bodies 56 and a retaining washer 58. In this embodiment of the anchor fitting, the shank portion 60 of the anchor body 54 defines a slit 62 therein and a diametrical hole 66 near the free end 68 thereof, the hole permitting required threading of an assembly cord 70 through the various components to permit assembly of the anchor fitting in a manner similar to that described with reference to the anchor fitting 10. In this case, as opposed to the shank portion 60 of the anchor body 54 being pulled through the holes in the shoulder defining bodies 56 and in the ball 52 by the assembly cord passing through the passages 24 and 25, as is the case in relation to the anchor fitting 10 (see FIG. 2), the shank portion 60 clearly is now pulled through the holes by the assembly cord passing through the diametrical hole 66 near the end 68 of the body 54.

For this embodiment anchor fitting, the stem for a tail for a ball can be effectively anchored to the anchor body 54 via a flat segment fitting into the slit 62, specifically into a position in which the hole 66 is in register with a hole through the said segment. A suitable locking pin passing through the aligned passage and hole can thus secure the location of the stem with respect to the anchor body.

Figure 7:
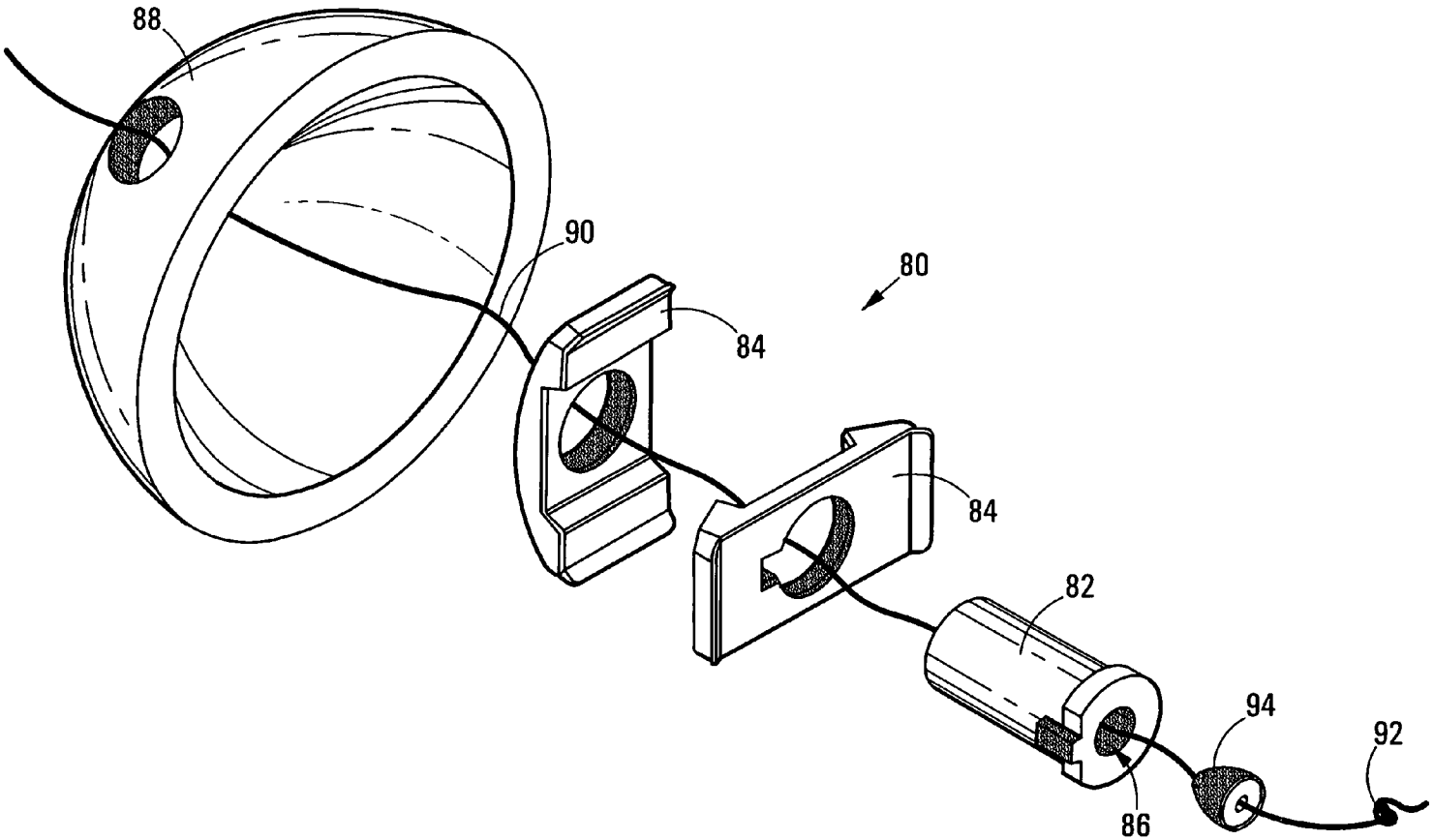
FIG. 7 shows a three-dimensional view of a third embodiment of an anchor fitting for a ball, in accordance with the invention.

Referring particularly to FIG. 7 of the drawings, a third embodiment of an anchor fitting, in accordance with the invention, is designated generally by the reference numeral 80. This anchor fitting 80 again includes an anchor body 82 and two shoulder bodies 84, the anchor body in this case merely defining an axial passage 86 therethrough. This fitting 80 is provided particularly for anchoring a cord to a ball 88 (only half the ball being shown) for using the ball in a tether ball-type game, the cord 90 being illustrated and being threaded through a hole in the ball, through holes in the shoulder defining bodies 84 and through the passage in the anchor body 82, the end of the cord beyond the anchor body 82 being provided with a knot 92, to prevent retraction thereof. A bearing body 94 is located between the anchor body 82 and the knot 92, the anchor fitting being assembled by merely pulling on the cord 90, to provide for the inter-engagement of the parts in a similar manner to that described above with reference to the anchor fittings 10 and 50. When so assembled, the bearing body 94 will bear against the head of the anchor body 82 and thereby provide for free rotation of the cord 90 within the passage through the anchor body, during play of a tether ball-type game with the ball. It will be understood that the cord 90 will thus simultaneously fulfil the function of an assembly cord and the cord for the ball for use in a tether ball-type game.

Further embodiments of anchor fittings, in accordance with the invention, are envisaged, the further embodiments always incorporating the fact that relatively small components, that can be inserted into a ball through a hole in the ball relatively easily without damaging the ball, are provided, these components being configured to cooperate with one another to form a large anchor formation within the associated ball, the anchor formation fulfilling the purpose of anchoring any one of a cord, a tail, and a stem for a tail, to the associated ball. The "large" anchor formation, in use of the associated ball, will serve to reduce/spread shock loads acting on the wall of the ball, thus "minimizing" damage to the wall of the ball. The large surface area created by the shoulder formations clearly can be increased in size even further by increasing the number of shoulder defining bodies as part of the anchor fitting, or the effective length of the shoulder defining bodies.

Furthermore, even though the assembly of the anchor fittings as above described require the use of an assembly cord, alternative configuration flexible assembly elements that can engage the anchor body of the anchor fitting also can be provided for the purpose.

The invention extends also to a method of anchoring an anchor fitting, in accordance with the invention, to a ball, which method involves the use of an assembly cord and includes the steps above described. Still further, the invention extends to a ball including an anchor fitting, in accordance with the invention, as part thereof.

The invention claimed is:

1. An anchor fitting for a ball which includes, in its operative configuration with respect to a ball, two shoulder defining bodies of a substantially rigid material which each defines a hole therethrough and which, when operatively positioned with their respective holes in register with the hole in the ball, form two pairs of shoulder formations that extend substantially perpendicularly with respect to one another and substantially radially with respect to the hole in the ball and that abut the interior side of the wall forming the ball; and an anchor body of a substantially rigid material which defines an elongate shank portion and a head at one end of the shank portion, the shank portion operatively extending through the hole in each shoulder defining body and the hole in the ball and the head bearing against one shoulder defining body for holding the two shoulder defining bodies in position, and in which the anchor body defines for the assembly of the ball an engagement formation which permits engagement by an elongate assembly element in a configuration in which, with the assembly element passing through the respective holes in the shoulder defining bodies and with the shoulder defining bodies and the anchor body separately displaced through the hole in the ball, the assembly element may be pulled externally of the ball for locating the shoulder defining bodies and the anchor body in their operative configurations with respect to the ball; and an anchoring formation which permits anchoring a required one of a cord, a tail and a stem for a tail, thereto.

2. An anchor fitting as claimed in claim 1, in which the shoulder defining bodies define complementary locating formations that serve to locate the bodies with respect to one another during assembly of the anchor fitting with the aid of an assembly element that passes through the holes in the shoulder defining bodies and that engages the anchor body.

3. An anchor fitting as claimed in claim 1, in which the shoulder defining bodies each comprises an elongate body that is provided with a curved surface profile segment that is complementary to and that abuts the interior side of the wall forming the ball, in its operative configuration.

4. An anchor fitting as claimed in claim 3, in which the length of each elongate body is equal to at least two times the diameter of the hole in the ball, with respect to which the anchor fitting is operatively associated.

5. An anchor fitting as claimed in claim 1, which includes a retaining body operatively securely located on the shank portion of the anchor body, externally of the ball, for securing the location of the anchor fitting on the ball.

6. An anchor fitting as claimed in claim 5, in which the retaining body is a washer-like formation that is resiliently deformable to permit its displacement over the shank portion of the anchor body into engagement with a peripheral groove defined therefor within the shank portion of the anchor body.

7. An anchor fitting as claimed in claim 1, in which the engagement formation defined by the anchor body is a passage arrangement defined by a first passage extending axially through the elongate shank portion and the head of the anchor body and a second passage extending radially through the head of the anchor body from an external location on the head to the first passage.

8. An anchor fitting as claimed in claim 1, which the engagement formation defined by the anchor body is a passage in the shank portion of the anchor body near the end thereof remote from the head thereof.

9. An anchor fitting as claimed in claim 1, in which the engagement formation defined by the anchor body is a passage that extends axially through the elongate shank portion and the head of the anchor body.

10. An anchor fitting as claimed in claim 9, in which the anchoring formation permits anchoring of a cord to the anchor body and is defined by the axial passage through the elongate shank portion and the head of the anchor body that forms the engagement formation, the axial passage permitting the cord to extend therethrough into the ball with a knot at the end of the cord within the ball preventing retraction of the cord and permitting the cord also to serve the purpose of the elongate assembly element.

11. An anchor fitting as claimed in claim 10, which includes an intermediate body operatively located between the knot at the end of the cord and the head of the anchor body to operatively bear against the head of the anchor body in use of the ball and to permit free rotation of the cord within the axial passage defined through the elongate shank portion and the head of the anchor body.

12. An anchor fitting as claimed in claim 1, in which the anchoring formation permits anchoring a stem for a tail for a ball to the anchor body, the anchoring formation being defined by the shank portion for the anchor body by a receiving formation formed to receive and locate a complementary formation defined at the end of the stem.

13. An anchor fitting as claimed in claim 12, in which the receiving formation is defined internally within the shank portion of the anchor body, the shank portion defining a slit formation therein that permits the passage of the complementary formation into the receiving formation through resilient deformability of the shank portion.

14. An anchor fitting as claimed in claim 5, in which the retaining body serves to enhance the secure location of the stem for a tail for a ball with respect to the anchor body.

15. A ball which includes an anchor fitting as claimed in claim 1.

16. A ball as claimed in claim 15, which includes one of a cord, a tail and a stem for a tail anchored to the anchor body of the anchor fitting via the anchoring formation defined by the anchor body.

17. An anchor fitting as claimed in claim 6, in which the retaining body serves to enhance the secure location of the stem for a tail for a ball with respect to the anchor body.

* * * * *